US011773463B2

(12) United States Patent
Kim et al.

(10) Patent No.: US 11,773,463 B2
(45) Date of Patent: Oct. 3, 2023

(54) NON-ORIENTED ELECTRICAL STEEL SHEET AND METHOD FOR PREPARING SAME

(71) Applicant: POSCO, Pohang-si (KR)

(72) Inventors: Jae-Hoon Kim, Pohang-si (KR); Wonjin Kim, Pohang-si (KR); Yong-Soo Kim, Pohang-si (KR); Su-Yong Shin, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 462 days.

(21) Appl. No.: 16/957,834

(22) PCT Filed: May 16, 2018

(86) PCT No.: PCT/KR2018/005622
§ 371 (c)(1),
(2) Date: Jun. 25, 2020

(87) PCT Pub. No.: WO2019/132128
PCT Pub. Date: Jul. 4, 2019

(65) Prior Publication Data

US 2021/0062284 A1 Mar. 4, 2021

(30) Foreign Application Priority Data

Dec. 26, 2017 (KR) ..... 10-2017-0179446

(51) Int. Cl.

| | |
|---|---|
| ***C22C 38/06*** | (2006.01) |
| ***C21D 9/46*** | (2006.01) |
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***H01F 1/147*** | (2006.01) |

(52) U.S. Cl.
CPC ..... *C21D 9/46* (2013.01); *C21D 6/005* (2013.01); *C21D 6/008* (2013.01); *C21D 8/005* (2013.01); *C21D 8/1222* (2013.01); *C21D 8/1233* (2013.01); *C21D 8/1272* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *H01F 1/147* (2013.01)

(58) Field of Classification Search
CPC ..... C21D 9/46
See application file for complete search history.

(56) References Cited

U.S. PATENT DOCUMENTS

| | | | |
|---|---|---|---|
| 5,258,080 A | 11/1993 | Buerger et al. | |
| 2005/0247373 A1 | 11/2005 | Hammer et al. | |
| 2009/0202383 A1* | 8/2009 | Tanaka | C22C 38/004 148/624 |
| 2011/0042625 A1 | 2/2011 | Tanaka et al. | |
| 2014/0072471 A1 | 3/2014 | Miyazaki et al. | |
| 2015/0000794 A1 | 1/2015 | Zou et al. | |
| 2017/0362677 A1 | 12/2017 | Kim et al. | |

FOREIGN PATENT DOCUMENTS

| | | | |
|---|---|---|---|
| CN | 107109583 | A | 8/2017 |
| EP | 2708615 | A1 | 3/2014 |
| EP | 3187611 | A1 | 7/2017 |
| JP | H10212556 | A | 8/1998 |
| JP | H10-310850 | A | 11/1998 |
| JP | 2001-335897 | A | 12/2001 |
| JP | 2005-525469 | A | 8/2005 |
| JP | 2007-031793 | A | 2/2007 |
| JP | 2007-039721 | A | 2/2007 |
| JP | 4779474 | B2 | 9/2011 |
| JP | 2013-044010 | A | 3/2013 |
| JP | 2016-156044 | A | 9/2016 |
| KR | 10-0479992 | B1 | 3/2005 |
| KR | 10-1059577 | B1 | 8/2011 |
| KR | 10-2013-0140208 | A | 12/2013 |
| KR | 10-2014-0060727 | A | 5/2014 |
| KR | 10-2015-0045993 | A | 4/2015 |
| KR | 10-2018-0070949 | A | 6/2018 |
| KR | 10-2018-0070950 | A | 6/2018 |
| KR | 10-2019-0078251 | A | 7/2019 |
| KR | 10-2019-0078385 | A | 7/2019 |

(Continued)

OTHER PUBLICATIONS

Extended European Search Report dated Aug. 26, 2020 issued in European Patent Application No. 18894426.8.
International Search Report dated Aug. 7, 2018, issued in International Patent Application No. PCT/KR2018/005622.
Chinese Office Action dated Jul. 5, 2021, issued in corresponding Chinese Patent Application No. 201880084859.1.
Japanese Office Action dated Jul. 6, 2021, issued in corresponding Japanese Patent Application No. 2020-536063.

(Continued)

*Primary Examiner* — Jophy S. Koshy

(74) *Attorney, Agent, or Firm* — Morgan, Lewis & Bockius LLP

(57) ABSTRACT

A non-oriented electrical steel sheet according to an exemplary embodiment of the present invention includes at least one of 2.0 to 3.5% of Si, 0.3 to 3.5% of Al, 0.2 to 4.5% of Mn, 0.0030 to 0.2% of Sn, 0.0030 to 0.15% of Sb, 0.0040 to 0.18% of P, 0.0005 to 0.02% of Zn, and 0.0005 to 0.01% of Y for wt %, a remainder of Fe, and inevitable impurities, and satisfying Formula 1:

$$0.05 \leq ([Sn]+[Sb])/[P] \leq 25 \quad \text{[Formula 1]}$$

(here, [Sn], [Sb], and [P] represent contents (wt %) of Sn, Sb, and P.)

14 Claims, 1 Drawing Sheet

(56) References Cited

FOREIGN PATENT DOCUMENTS

| | | | | | |
|---|---|---|---|---|---|
| WO | 2013/121924 | A1 | | 8/2013 | |
| WO | WO-2016105058 | A1 | * | 6/2016 | ..... C21D 6/008 |
| WO | 2017/111548 | A1 | | 6/2017 | |
| WO | 2017/111549 | A1 | | 6/2017 | |

* cited by examiner

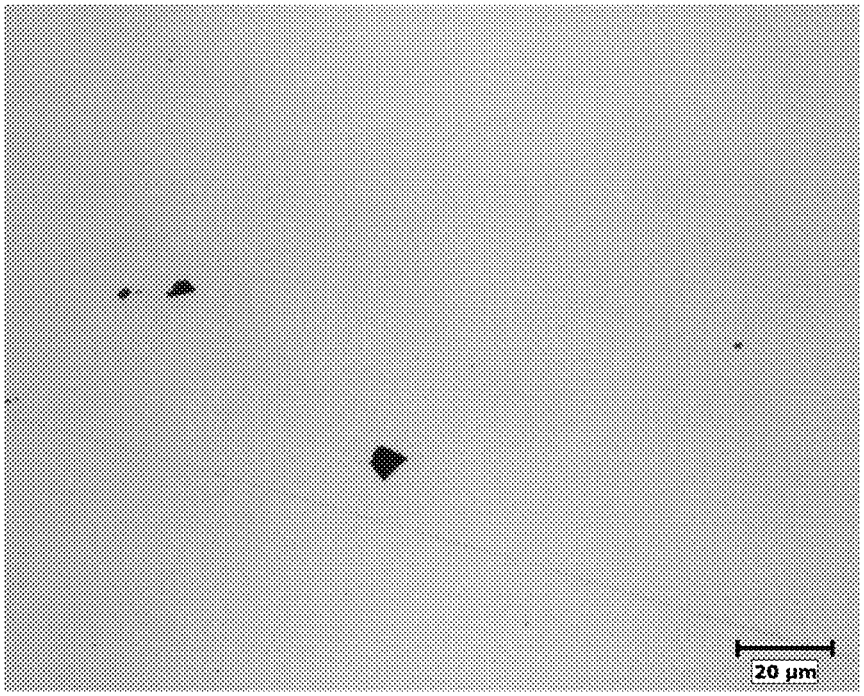
20 μm

NON-ORIENTED ELECTRICAL STEEL SHEET AND METHOD FOR PREPARING SAME

CROSS-REFERENCE OF RELATED APPLICATIONS

This application is the U.S. National Phase under 35 U.S.C. § 371 of International Patent Application No. PCT/KR2018/005622, filed on May 16, 2018, which in turn claims the benefit of Korean Application No. 10-2017-0179446, filed on Dec. 26, 2017, the entire disclosures of which applications are incorporated by reference herein.

BACKGROUND OF THE INVENTION

(a) Field of the Invention

The present disclosure relates to a non-oriented electrical steel sheet and a manufacturing method thereof. In particular, it relates to a non-oriented electrical steel sheet for providing high permeability, low high-frequency iron loss, and high magnetic flux density by mutually controlling contents of segregated elements included in a steel sheet, and a manufacturing method thereof.

(b) Description of the Related Art

An efficient use of electrical energy has become a big issue so as to improve global environments such as through energy saving, reduction of generation of fine dusts, and reduction of greenhouse gases. More than 50% of the entire electrical energy that is currently developed is consumed by electric motors, so high efficiency of the electric motors is indispensable for efficient use of electricity. Recently, as the field of environmentally-friendly automobiles (hybrids, plug-in hybrids, electric vehicles, fuel cell vehicles) has been rapidly developed, interests in high-efficiency driving motors are rapidly increasing, with recognition of high efficiency such as high efficiency motors for home appliances or super premium motors for heavy electric machines, and as governmental regulations continue, demands for efficient use of electrical energy are higher than ever. For the purpose of high efficiency of the electric motors, optimization is very important in all areas covering selection of materials, design, assembling, and control. Particularly, on the material side, a magnetic characteristic of the electrical steel sheet is the most important, and there are high demands on low iron loss and high magnetic flux density. A high-frequency low iron loss characteristic is very important for automobile driving motors or motors for air conditioner compressors that are to be driven in the commercial frequency range and the high frequency range. To obtain the high-frequency low iron loss characteristic, in a process for preparing a steel sheet, a large amount of specific resistance elements such as Si, Al, or Mn are to be added, and inclusions and fine precipitates in the steel sheet must be aggressively controlled so that they may not hinder movement of a magnetic domain wall. However, to purify impurity elements such as C, S, N, Ti, Nb, or V to a lowest level in steelmaking for the purpose of controlling inclusions and fine precipitates, a high-quality raw material must be used, and much time is used for secondary refinement, thereby worsening productivity. Therefore, researches on addition of a large amount of specific resistance elements such as Si, Al, or Mn and controlling of impurity elements to the lowest level are in progress, but actual applying results thereof are insignificant. The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention has been made in an effort to provide a non-oriented electrical steel sheet for improving magnetism by minimizing fine impurities such as inclusions or precipitates and allowing fluent movement of a magnetic domain wall without reinforcing secondary refinement in steelmaking, and a manufacturing method thereof.

The present invention has been made in an effort to provide a non-oriented electrical steel sheet with excellent magnetism as well as productivity, and a manufacturing method thereof.

An exemplary embodiment of the present invention provides a non-oriented electrical steel sheet including: at least one of 2.0 to 3.5% of Si, 0.3 to 3.5% of Al, 0.2 to 4.5% of Mn, 0.0030 to 0.2% of Sn, 0.0030 to 0.15% of Sb, 0.0040 to 0.18% of P, 0.0005 to 0.02% of Zn, and 0.0005 to 0.01% of Y as wt %, a remainder of Fe, and inevitable impurities, and satisfying Formula 1.

$$0.05 \leq ([Sn]+[Sb])/[P] \leq 25 \quad \text{[Formula 1]}$$

(Here, [Sn], [Sb], and [P] represent contents (wt %) of Sn, Sb, and P.)

The non-oriented electrical steel sheet according to an exemplary embodiment of the present invention may include 0.0005 to 0.02% of Zn and 0.0005 to 0.01% of Y.

The non-oriented electrical steel sheet according to an exemplary embodiment of the present invention may satisfy Formula 2.

$$[Zn]/[Y] > 1 \quad \text{[Formula 2]}$$

(Here, [Zn] and [Y] respectively represent contents (wt %) of Zn and Y.)

The non-oriented electrical steel sheet according to an exemplary embodiment of the present invention may satisfy Formula 3.

$$[Zn]+[Y] \leq 0.025 \quad \text{[Formula 3]}$$

(Here, [Zn] and [Y] respectively represent contents (wt %) of Zn and Y.)

The non-oriented electrical steel sheet according to an exemplary embodiment of the present invention may further include at least one of equal to or less than 0.0040% of N (excluding 0%), equal to or less than 0.0040% of C (excluding 0%), equal to or less than 0.0040% of S (excluding 0%), equal to or less than 0.0040% of Ti (excluding 0%), equal to or less than 0.0040% of Nb (excluding 0%), and equal to or less than 0.0040% of V (excluding 0%).

The non-oriented electrical steel sheet according to an exemplary embodiment of the present invention may include inclusions, and the inclusions with a diameter of 0.5 to 1.0 μm may occupy 40 vol % or more of the entire inclusions.

The inclusions with the diameter of 2 μm or less may occupy 80 vol % or more of the entire inclusions.

The non-oriented electrical steel sheet according to an exemplary embodiment of the present invention may include inclusions, and an area of the entire inclusions for an area of the entire non-oriented electrical steel sheet may be equal to or less than 0.2%.

The non-oriented electrical steel sheet according to an exemplary embodiment of the present invention may have an average crystal grain size of 50 to 95 μm.

Another embodiment of the present invention provides a method for manufacturing a non-oriented electrical steel sheet, including: manufacturing a slab including at least one of 2.0 to 3.5% of Si, 0.3 to 3.5% of Al, 0.2 to 4.5% of Mn, 0.0030 to 0.2% of Sn, 0.0030 to 0.15% of Sb, 0.0040 to 0.18% of P, 0.0005 to 0.02% of Zn, and 0.0005 to 0.01% of Y as a wt %, a remainder of Fe, and inevitable impurities, and satisfying Formula 1; heating the slab; manufacturing a hot-rolled steel sheet by hot rolling the slab; manufacturing a cold-rolled steel sheet by cold rolling the hot-rolled steel sheet; and finally annealing the cold-rolled steel sheet.

$$0.05 \leq ([Sn]+[Sb])/[P] \leq 25 \quad \text{[Formula 1]}$$

(Here, [Sn], [Sb], and [P] represent contents (wt %) of Sn, Sb, and P.)

The slab may include 0.0005 to 0.02% of Zn and 0.0005 to 0.01% of Y.

The slab may satisfy Formula 2.

$$[Zn]/[Y] > 1 \quad \text{[Formula 2]}$$

(Here, [Zn] and [Y] respectively represent contents (wt %) of Zn and Y.)

The slab may satisfy Formula 3.

$$[Zn]+[Y] \leq 0.025 \quad \text{[Formula 3]}$$

(Here, [Zn] and [Y] respectively represent contents (wt %) of Zn and Y.)

The slab may further include: at least one of equal to or less than 0.0040% of N (excluding 0%), equal to or less than 0.0040% of C (excluding 0%), equal to or less than 0.0040% of S (excluding 0%), equal to or less than 0.0040% of Ti (excluding 0%), equal to or less than 0.0040% of Nb (excluding 0%), and equal to or less than 0.0040% of V (excluding 0%).

The non-oriented electrical steel sheet according to an exemplary embodiment of the present invention includes Zn and Y within a predetermined range, thereby improving the cleanliness of molten steel and coarsening the inclusions and precipitates.

Further, the non-oriented electrical steel sheet that is appropriate for high-rate rotation by improving the texture by addition of segregated elements such as Sn, Sb, or P and thereby improving the high-frequency iron loss and the low magnetic field characteristic.

Through this, environment-friendly motors for automobiles, high efficiency motors for home appliances, and super premium electric motors may be manufactured.

BRIEF DESCRIPTION OF THE DRAWING

FIG. 1 shows a photograph for enlarging an inclusion in an oriented electrical steel sheet manufactured according to an example (Classification 1).

DETAILED DESCRIPTION OF THE EMBODIMENTS

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

The technical terms used herein are to simply mention a particular exemplary embodiment and are not meant to limit the present invention. An expression used in the singular encompasses the expression of the plural, unless it has a clearly different meaning in the context. In the specification, it is to be understood that the terms such as "including", "having", etc., are intended to indicate the existence of specific features, regions, numbers, stages, operations, elements, components, or combinations thereof disclosed in the specification, and are not intended to preclude the possibility that one or more other specific features, regions, numbers, operations, elements, components, or combinations thereof may exist or may be added.

When a part is referred to as being "on" another part, it can be directly on the other part or intervening parts may also be present. In contrast, when an element is referred to as being "directly on" another element, there are no intervening elements therebetween.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have meanings equal to the contextual meanings in the relevant field of art, and are not to be interpreted to have idealized or excessively formal meanings unless clearly defined in the present application.

Unless otherwise specified, % represents wt %, and 1 ppm is 0.0001 wt %.

In an exemplary embodiment of the present invention, further including an additional element signifies that the added element is substituted for iron (Fe) that is a remainder.

An exemplary embodiment of the present invention will be described more fully hereinafter so that a person skilled in the art may easily realize the same. As those skilled in the art would realize, the described embodiments may be modified in various different ways, all without departing from the spirit or scope of the present invention.

In an exemplary embodiment of the present invention, a composition in a non-oriented electrical steel sheet, particularly, a range of Si, Al, and Mn that are major added components, is optimized, and an added amount of Zn and Y that are microelements is limited and segregated elements such as Sn, Sb, or P are simultaneously controlled, thereby significantly improving texture and magnetism.

The non-oriented electrical steel sheet according to an exemplary embodiment of the present invention includes at least one of 2.0 to 3.5% of Si, 0.3 to 3.5% of Al, 0.2 to 4.5% of Mn, 0.0030 to 0.2% of Sn, 0.0030 to 0.15% of Sb, 0.0040 to 0.18% of P, 0.0005 to 0.02% of Zn, and 0.0005 to 0.01% of Y with reference to wt %, and a remainder includes Fe and inevitable impurities, and satisfies Formula 1.

A reason for limiting a component of a non-oriented electrical steel sheet will now be described.

2.0 to 3.5 wt % of Si

The silicon (Si) increases specific resistance of a material to reduce iron loss, and when a very small amount thereof is added, an effect of improving a high-frequency iron loss may be insufficient. When a very large amount thereof is added, on the contrary, rigidity of the material increases, a cold rolling property is severely worsened, so productivity and punching property may be deteriorated. Therefore, Si may be added in the above-noted range. In detail, 2.3 to 3.3 wt % of Si may be contained.

0.3 to 3.5 wt % of Al

The aluminum (Al) increases specific resistance of a material to reduce iron loss, and when a very small amount thereof is added, there is no effect in reducing the high-frequency iron loss, and a nitride is finely formed, so magnetism may be deteriorated. When a very large amount thereof is added, on the contrary, it may generate problems in all processes such as steelmaking and continuous casting, thereby substantially deteriorating productivity. Therefore, Al may be added in the above-noted range. In detail, 0.5 to 3.3 wt % of Al may be contained.

0.2 to 4.5 wt % of Mn

The manganese (Mn) increases specific resistance of a material to improve the iron loss and form a sulfide, and when a very small amount thereof is added, a very small amount of MnS is precipitated to deteriorate magnetism. When a very large amount thereof is added, formation of the texture of [111] that is disadvantageous to magnetism may be promoted to reduce the magnetic flux density. Therefore, Mn may be added in the above-noted range. In detail, 0.7 to 3.5 wt % of Mn may be contained.

0.0030 to 0.2 wt % of Sn and 0.0030 to 0.15 wt % of Sb

The tin (Sn) and the antimony (Sb) improves texture of a material and suppresses surface oxidation, so they may be added so as to improve the magnetism. When very small amounts of Sn and Sb are added, the effect may be negligible. When a very large amount of Sn or Sb is added, segregation of a grain boundary may increase to thus reduce integration of texture, and increase rigidity and accordingly may cause a cold-rolled steel sheet to fracture. Therefore, equal to or less than 0.2 wt % of Sn and equal to or less than 0.15 wt % of Sb may be contained. When the content of Sn and Sb is equal to or less than 0.2 wt %, cold rolling may be easily performed. In detail, 0.005 to 0.15 wt % of Sn and 0.005 to 0.13 wt % of Sb may be contained.

0.0040 to 0.18 wt % of P

The phosphorus (P) increases specific resistance of a material, and segregates a boundary to improve texture and increase magnetism. When a very small amount of phosphorus (P) is added, the segregation amount is much less, and there may be no texture improving effect. When a very large amount of phosphorus (P) is added, formation of texture that is disadvantageous to magnetism may be generated, so there may be no texture improving effect, severe segregation to the boundary may be generated, the rolling property may be deteriorated, and its production may be difficult. In detail, 0.007 to 0.17 wt % of P may be contained.

The non-oriented electrical steel sheet according to an exemplary embodiment of the present invention satisfies Formula 1.

$$0.05 \leq ([Sn]+[Sb])/[P] \leq 25 \quad \text{[Formula 1]}$$

(Here, [Sn], [Sb], and [P] represent contents (wt %) of Sn, Sb, and P.)

When the value of Formula 1 is less than 0.05, segregation of P is severely performed, so the direction of <111> that is disadvantageous to magnetism may promote formation of texture (also referred to as texture of <111>/ND) in parallel to a normal direction of a rolling side of the steel sheet (or an ND direction) within 15 degrees, and magnetism may be deteriorated. When the value of Formula 1 is greater than 25, crystal grain growth may be deteriorated, there is no texture improving effect, and an annealing temperature increases very high, so annealing productivity may also be deteriorated.

At least one of 0.0005 to 0.02 wt % of Zn and 0.0005 to 0.01 wt % of Y

The zinc (Zn) reacts with an impurity element and improves cleanliness of molten steel. When a very small amount thereof is added, an inclusion may be coarsened and the cleanliness of molten steel may not be improved. When a very large amount thereof is added, on the contrary, formation of fine precipitates is promoted. Therefore, Zn may be added in the above-noted range.

The yttrium (Y) is added to function as an additive for supporting coarsening of an inclusion of Zn. When Y is added, it supports coarsening of the inclusion of Zn, suppresses re-melting of the inclusion generated in a subsequent annealing process, and reduces fine precipitates. When a very large amount thereof is added, it may promote formation of fine precipitates and may deteriorate the iron loss.

In an exemplary embodiment of the present invention, at least one of Zn and Y may be contained. That is, Zn may be contained, Y may be contained, or Zn and Y may be simultaneously contained. When Zn is contained, 0.0005 to 0.02 wt % of Zn may be contained. When Y is contained, 0.0005 to 0.01 wt % of Y may be contained. When Zn and Y are simultaneously contained, 0.0005 to 0.02 wt % of Zn and 0.0005 to 0.01 wt % of Y may be contained.

In detail, Zn and Y may be simultaneously contained, and 0.0005 to 0.02 wt % of Zn and 0.0005 to 0.01 wt % of Y may be contained. In further detail, 0.001 to 0.01 wt % of Zn and 0.0007 to 0.005 wt % of Y may be contained.

Zn and Y may satisfy Formula 2.

$$[Zn]/[Y] > 1 \quad \text{[Formula 2]}$$

(Here, [Zn] and [Y] respectively represent contents (wt %) of Zn and Y.)

Y represents an element for supporting the function of Zn, so when the added amount of Y is greater than that of Zn, it may hinder coarsening of the inclusion to promote fine precipitation. Therefore, the ratio may be limited as expressed in Formula 2.

Zn and Y may satisfy Formula 3.

$$[Zn]+[Y] \leq 0.025 \quad \text{[Formula 3]}$$

(Here, [Zn] and [Y] respectively represent contents (wt %) of Zn and Y.)

When the summed amount of Zn and Y becomes very large, formation of fine precipitates may be promoted and the iron loss may be deteriorated. Therefore, the summed amount may be limited as expressed in Formula 3.

Equal to or Less than 0.0040 wt % of N

The nitrogen (N) forms fine and long AlN precipitates in a base material, and it also combines with other impurities to form a fine nitride, suppress growth of crystal grains, and deteriorate the iron loss, so it needs to be limited to be equal to or less than 0.0040 wt %, in detail, equal to or less than 0.0030 wt %.

Equal to or Less than 0.0040 wt % of C

The carbon (C) causes magnetic aging, and combines with other impurity elements to produce a carbide and deteriorates a magnetic characteristic, so it need be limited to be equal to or less than 0.0040 wt %, and in detail, equal to or less than 0.0030 wt %.

Equal to or Less than 0.0040 wt % of S

The sulfur (S) forms a sulfide such as MnS in reaction with Mn to deteriorate growth of crystal grains and suppress movement of magnetic domains, so it preferably needs to be controlled to be equal to or less than 0.0040 wt %. In detail, it need be controlled to be equal to or less than 0.0030 wt %.

Equal to or Less than 0.0040 wt % of Ti

The titanium (Ti) forms a carbide or a nitride to suppress growth of crystal grains and movement of magnetic domains, so it needs to be controlled to be equal to or less than 0.0040 wt %, and in detail, equal to or less than 0.0020 wt %.

Equal to or Less than 0.0040 wt % of Nb

The niobium (Nb) forms a carbide or a nitride to suppress growth of crystal grains and movement of magnetic domains, so it needs to be controlled to be equal to or less than 0.0040 wt %, and in detail, equal to or less than 0.0020 wt %.

Equal to or Less than 0.0040 wt % of V

The vanadium (V) forms a carbide or a nitride to suppress growth of crystal grains and movement of magnetic domains, so it needs to be controlled to be equal to or less than 0.0040 wt %, and in detail, equal to or less than 0.0020 wt %.

Other Impurities

Inevitable impurities such as Mo, Mg, or Cu may be contained in addition to the above-described elements. The elements are traces, but cause deterioration of magnetism by formation of inclusions in the steel, so Mo and Mg must be respectively controlled to be equal to or less than 0.005 wt %, and Cu must be controlled to be equal to or less than 0.025 wt %.

In an exemplary embodiment of the present invention, predetermined amounts of Sn, Sb, and P that are segregated elements are added together with Zn and Y to thus appropriately control the size of the inclusions, and ultimately improve the magnetism of the non-oriented electrical steel sheet. In detail, regarding the non-oriented electrical steel sheet according to an exemplary embodiment of the present invention, the inclusions with a diameter of 0.5 to 1.0 μm may occupy 40 or more vol % of the entire inclusions. In this instance, the diameter of the inclusions represents the diameter of a circle that is a presumed virtual circle with the same area as the inclusion. The inclusion improves mobility of the magnetic domain to express an excellent magnetic characteristic. In further detail, the inclusion with the diameter of equal to or less than 2μ may occupy 80 or more vol % of the entire inclusions.

The non-oriented electrical steel sheet includes inclusions, and the area of the entire inclusions for the area of the entire non-oriented electrical steel sheet may be equal to or less than 0.2%.

An average crystal grain size of the non-oriented electrical steel sheet according to an exemplary embodiment of the present invention may be 50 to 95 μm. In the above-noted range, the non-oriented electrical steel sheet has further excellent magnetism.

As described above, the non-oriented electrical steel sheet according to an exemplary embodiment of the present invention improves the high-frequency iron loss and the low magnetic field characteristic. In detail, the magnetic flux density at 50 Hz 100 Nm may be equal to or greater than 0.8 T, and the high-frequency iron loss ratio (1000 Hz/10,000 Hz×100) at 0.1 T may be equal to or less than 3.2%. This signifies that the high-frequency iron loss is excellent in the range of several tens of kHz in addition to the range of several hundreds of Hz. When the ratio is greater than 3.2%, it causes the entire motor efficiency to become poor as the difference of iron losses between the high-rate rotation and the low-rate rotation becomes large.

A method for manufacturing a non-oriented electrical steel sheet according to an exemplary embodiment of the present invention includes: manufacturing a slab including at least one of 2.0 to 3.5% of Si, 0.3 to 3.5% of Al, 0.2 to 4.5% of Mn, 0.0030 to 0.2% of Sn, 0.0030 to 0.15% of Sb, 0.0040 to 0.18% of P, 0.0005 to 0.02% of Zn, and 0.0005 to 0.01% of Y, as wt %, a remainder of Fe, and inevitable impurities; heating the slab; manufacturing a hot-rolled steel sheet by hot rolling the slab; manufacturing a cold-rolled steel sheet by cold rolling the hot-rolled steel sheet; and finally annealing the cold-rolled steel sheet.

The respective steps will now be described in detail.

First, the slab is manufactured. The reasons for limiting the added ratios of the compositions in the slab correspond to the previously-described reasons for limiting the compositions of the non-oriented electrical steel sheet, so no repeated descriptions will be provided. In the manufacturing process including hot rolling, hot-rolled steel sheet annealing, cold rolling, and final annealing to be described, the compositions of the slab are not substantially changed, so the compositions of the slab substantially correspond to the compositions of the non-oriented electrical steel sheet.

The slab may be manufactured by adding a ferroalloy of Si, a ferroalloy of Al, and a ferroalloy of Mn to molten steel, adding at least one of Zn and Y to the molten steel, adding Sn, Sb, and P to the molten steel and bubbling the same by use of an inert gas, and continuously casting the same. The ferroalloy of Si, the ferroalloy of Al, the ferroalloy of Mn, and Zn may be adjusted to be within the range of the compositions of the slab and may then be input. Regarding the bubbling by use of an inert gas, the inert gas may be gas of Ar. The bubbling may be performed for five or more minutes so that Zn, Y, Sn, Sb, and P may sufficiently react.

The slab is then heated. In detail, the slab is charged into a heating furnace and is heated at 1100 to 1250° C. When heated at more than the temperature of 1250° C., precipitates may be re-melted, and they may be finely precipitated after hot rolling.

The heated slab is hot rolled to 2 to 2.3 mm to be manufactured as a hot-rolled steel sheet. In the manufacturing of a hot-rolled steel sheet, a finishing rolling temperature may be 800 to 1000° C.

After the manufacturing of a hot-rolled steel sheet, annealing the hot-rolled steel sheet may further be included. In this instance, the hot-rolled steel sheet annealing temperature may be 850 to 1150° C. When the hot-rolled steel sheet annealing temperature is less than 850° C., texture may not grow or may grow finely, so a rising effect of magnetic flux density is less, and when the annealing temperature is greater than 1150° C., the magnetic characteristic is deteriorated, and rolling workability may be worse because of deformation of the plate shape. In detail, the temperature range may be 950 to 1125° C. In detail, the annealing temperature of the hot-rolled steel sheet may be 900 to 1100° C. The hot-rolled steel sheet annealing is performed, if needed, so as to increase the orientation that is advantageous to magnetism, and it may also be omitted.

The hot-rolled steel sheet is pickled and is cold rolled so that it may have a predetermined plate thickness. It may be differently applied depending on the thickness of the hot-rolled steel sheet, but it may be cold rolled by applying a reduction ratio of 70 to 95% so that the final thickness may be 0.2 to 0.65 mm.

The cold-rolled steel sheet that is finally cold rolled undergoes final annealing so that the average crystal grain size may be 50 to 95 μm. The final annealing temperature may be 850 to 1050° C. When the final annealing temperature is very low, recrystallization may be insufficiently generated, and when the final annealing temperature is very high, the crystal grains rapidly grow, so the magnetic flux density and the high-frequency iron loss may be deteriorated. In detail, it may be finally annealed at the temperature of 900 to 1000° C. In the final annealing process, the texture formed in the previous cold rolling step may be entirely (i.e., 99% or more) recrystallized.

After the final annealing, it may be cooled to 600° C. at a cooling rate of 25 to 50° C./s. The inclusions may be coarsened by cooling the same at an appropriate cooling rate.

Regarding the manufactured non-oriented electrical steel sheet, the inclusions with the diameter of 0.5 to 1.0 μm may occupy 40 vol % or more of the entire inclusions. The inclusions with the diameter of 2 μm or less may occupy 80 vol % or more of the entire inclusions. The area of the entire inclusions against the area of the entire non-oriented electrical steel sheet may be equal to or less than 0.2%.

The following examples and comparative examples illustrate the present invention in more detail. However, the examples are exemplary embodiments of the present invention, and the present invention is not limited to the same.

EXAMPLES

A slab composited as expressed in Table 1 is manufactured. C, S, N, and Ti except for the components expressed in Table 1 are controlled with 0.003 wt %. The slab is heated at 1150° C., and it is hot finishing rolled at 850° C. to manufacture a hot-rolled steel sheet with a plate thickness of 2.0 mm. The hot-rolled steel sheet that underwent hot rolling is annealed at 1100° C. for four minutes and is then pickled. It is then cold rolled to have a plate thickness of 0.25 mm, and it is finally annealed at 1000° C. for 45 seconds. It is cooled to 600° C. at a cooling rate of 30° C./s to finally manufacture a non-oriented electrical steel sheet. Magnetism is determined with a mean value of a rolling direction and a vertical direction by using a single sheet tester and is expressed in Table 3. The inclusions are observed by using an optical microscope, it has 500× magnification, an observation side is a cross-section (or a TD side) of the rolling vertical direction, and the observed area is at least 4 $mm^2$. FIG. 1 shows a photograph of inclusions according to Classification 1 of the example. The diameter of the inclusion is expressed as a diameter of a virtual circle with the same area. An area ratio of the inclusion with the diameter of 0.5 to 1.0 μm for the entire area of the inclusion is summarized in Table 3.

TABLE 1

| Classification | Si | Al | Mn | Zn | Y | Sn | Sb | P |
|---|---|---|---|---|---|---|---|---|
| 1 | 2 | 1.5 | 3 | 0.005 | 0.001 | 0.01 | 0.01 | 0.01 |
| 2 | 2 | 1.5 | 3 | 0.005 | 0.001 | 0.23 | 0.05 | 0.05 |
| 3 | 2 | 1.5 | 3 | 0.005 | 0.001 | 0.003 | 0.003 | 0.14 |
| 4 | 2 | 1.5 | 3 | 0.005 | 0.001 | 0.1 | 0.1 | 0.15 |
| 5 | 2 | 1.5 | 3 | 0.005 | 0.001 | 0.1 | 0.09 | 0.004 |
| 6 | 2 | 1.5 | 3 | 0.005 | 0.001 | 0.05 | 0.2 | 0.1 |
| 7 | 2 | 1.5 | 3 | 0.005 | 0.001 | 0.03 | 0.03 | 0.2 |
| 8 | 2 | 1.5 | 3 | 0.005 | 0.001 | 0.08 | 0.01 | 0.01 |
| 9 | 2.5 | 1 | 1 | 0.005 | 0.001 | 0.02 | 0.03 | 0.02 |
| 10 | 2.5 | 0.7 | 2.5 | 0.005 | 0.001 | 0.03 | 0.03 | 0.04 |
| 11 | 2.5 | 0.7 | 2.5 | 0.0003 | 0.0003 | 0.02 | 0.03 | 0.02 |
| 12 | 3 | 0.7 | 2 | 0.025 | 0.003 | 0.02 | 0.03 | 0.02 |
| 13 | 2 | 3 | 1.5 | 0.01 | 0.001 | 0.02 | 0.03 | 0.02 |
| 14 | 2.5 | 0.7 | 2.5 | 0.005 | 0.003 | 0.02 | 0.03 | 0.02 |
| 15 | 2.5 | 1 | 1 | 0.02 | 0.003 | 0.02 | 0.03 | 0.02 |
| 16 | 3 | 0.7 | 1.4 | 0.005 | 0.003 | 0.02 | 0.03 | 0.02 |
| 17 | 3 | 1 | 2 | 0.01 | 0.007 | 0.02 | 0.03 | 0.02 |

TABLE 2

| Classification | (Sn + Sb)/P | [Zn] + [Y] | [Zn]/[Y] | Specific resistance (μΩ · cm) | Remark |
|---|---|---|---|---|---|
| 1 | 2 | 0.006 | 5 | 70 | Example |
| 2 | 5.6 | 0.006 | 5 | 70 | Comparative Example |
| 3 | 0.04 | 0.006 | 5 | 70 | Comparative Example |
| 4 | 1.33 | 0.006 | 5 | 70 | Example |
| 5 | 48 | 0.006 | 5 | 70 | Comparative Example |
| 6 | 3 | 0.006 | 5 | 70 | Comparative Example |
| 7 | 0.3 | 0.006 | 5 | 70 | Comparative Example |
| 8 | 9 | 0.006 | 5 | 70 | Example |
| 9 | 2.5 | 0.006 | 5 | 58 | Example |
| 10 | 1.5 | 0.006 | 5 | 64 | Example |
| 11 | 2.5 | 0.0006 | 1 | 64 | Comparative Example |
| 12 | 2.5 | 0.028 | 8.33 | 66 | Comparative Example |
| 13 | 2.5 | 0.011 | 10 | 78 | Example |
| 14 | 2.5 | 0.008 | 1.67 | 64 | Example |
| 15 | 2.5 | 0.023 | 6.67 | 58 | Example |
| 16 | 2.5 | 0.008 | 1.67 | 63 | Example |
| 17 | 2.5 | 0.017 | 1.43 | 70 | Example |

TABLE 3

| Classification | Crystal grain size (μm) | Inclusion ratio (%) | B1 (T) | $W_{1/1000}$ (W/kg) | $W_{1/10000}$ (W/kg) | $W_{1/1000}/W_{1/10000} \times 100$ | Remark |
|---|---|---|---|---|---|---|---|
| 1 | 65 | 55 | 1.15 | 0.58 | 30.2 | 1.92 | Example |
| 2 | 45 | 38 | 0.71 | 1.12 | 34.1 | 3.28 | Comparative Example |
| 3 | 60 | 35 | 0.72 | 1.09 | 33.2 | 3.28 | Comparative Example |
| 4 | 75 | 65 | 1.19 | 0.52 | 27.1 | 1.92 | Example |
| 5 | 48 | 30 | 0.71 | 1.15 | 33.8 | 3.4 | Comparative Example |
| 6 | 45 | 31 | 0.68 | 1.08 | 33.5 | 3.22 | Comparative Example |
| 7 | 43 | 37 | 0.78 | 1.11 | 34.5 | 3.22 | Comparative Example |
| 8 | 78 | 62 | 1.09 | 0.66 | 26.8 | 2.46 | Example |
| 9 | 82 | 65 | 1.08 | 0.6 | 30.5 | 1.97 | Example |
| 10 | 75 | 48 | 1.18 | 0.66 | 29.2 | 2.26 | Example |
| 11 | 45 | 35 | 0.65 | 1.15 | 35.1 | 3.28 | Comparative Example |
| 12 | 45 | 30 | 0.75 | 1.11 | 33.1 | 3.35 | Comparative Example |
| 13 | 65 | 45 | 0.88 | 0.65 | 28.4 | 2.29 | Example |
| 14 | 75 | 48 | 0.97 | 0.84 | 29.8 | 2.82 | Example |
| 15 | 78 | 51 | 1.07 | 0.94 | 31.5 | 2.98 | Example |

TABLE 3-continued

| Classification | Crystal grain size (μm) | Inclusion ratio (%) | B1 (T) | $W_{1/1000}$ (W/kg) | $W_{1/10000}$ (W/kg) | $W_{1/1000}/W_{1/10000} \times 100$ | Remark |
|---|---|---|---|---|---|---|---|
| 16 | 70 | 52 | 1.02 | 0.91 | 30.2 | 3.01 | Example |
| 17 | 68 | 49 | 0.89 | 0.69 | 29.5 | 2.34 | Example |

As expressed in Table 1 to Table 3, in the case of a steel grade according to an example, the ratio of the inclusions with a predetermined diameter increases to thus find that it has excellent magnetism. On the contrary, in the case of the steel grade according to a comparative example where an added amount of Zn and Y exceeds a range or an added amount of Sn, Sb, and P exceeds a range, it fails to satisfy the inclusion characteristic and the crystal grain size range, and the magnetism is deteriorated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, the embodiments described above are only examples and should not be construed as being limitative in any respects.

What is claimed is:

1. A non-oriented electrical steel sheet comprising:

in wt % 2.0 to 3.5% of Si, 0.3 to 3.5% of Al, 0.2 to 4.5% of Mn, 0.0030 to 0.2% of Sn, 0.0030 to 0.15% of Sb, 0.0040 to 0.18% of P, and at least one of 0.0005 to 0.02% of Zn, and 0.0005 to 0.01% of Y; and a remainder of Fe, and inevitable impurities, wherein:

the non-oriented electrical steel sheet includes inclusions, and inclusions with a diameter of 0.5 to 1.0 μm occupy 40 vol % or more of the entire inclusions, and the non-oriented electrical steel sheet satisfies Formula 1:

$0.05 \leq ([Sn]+[Sb])/[P] \leq 25$ wherein [Sn], [Sb], and [P] represent contents of Sn, Sb, and P in wt %. [Formula 1]

2. The non-oriented electrical steel sheet of claim 1, wherein, in wt %, 0.0005 to 0.02% of Zn and 0.0005 to 0.01% of Y are included.

3. The non-oriented electrical steel sheet of claim 2, wherein Formula 2 is satisfied:

$[Zn]/[Y]>1$ wherein [Zn] and [Y] represent contents of Zn and Y in wt %. [Formula 2]

4. The non-oriented electrical steel sheet of claim 2, wherein Formula 3 is satisfied:

$[Zn]+[Y] \leq 0.025$ wherein [Zn] and [Y] represent contents of Zn and Y in wt %. [Formula 3]

5. The non-oriented electrical steel sheet of claim 1, further comprising:

in wt %, at least one of equal to or less than 0.0040% of N excluding 0%, equal to or less than 0.0040% of C excluding 0%, equal to or less than 0.0040% of S excluding 0%, equal to or less than 0.0040% of Ti excluding 0%, equal to or less than 0.0040% of Nb excluding 0%, and equal to or less than 0.0040% of V excluding 0%.

6. The non-oriented electrical steel sheet of claim 1, wherein inclusions with a diameter of 2 μm or less occupy 80 vol % or more of the entire inclusions.

7. The non-oriented electrical steel sheet of claim 1, wherein the non-oriented electrical steel sheet includes inclusions, and an area of the entire inclusions for an area of the entire non-oriented electrical steel sheet is equal to or less than 0.2%.

8. The non-oriented electrical steel sheet of claim 1, wherein an average crystal grain size is 50 to 95 μm.

9. The non-oriented electrical steel sheet of claim 1, wherein the inclusions with a diameter of 0.5 to 1.0 μm occupy 48 vol % or more of the entire inclusions.

10. A method for manufacturing a non-oriented electrical steel sheet, comprising:

manufacturing a slab including, in wt %, 2.0 to 3.5% of Si, 0.3 to 3.5% of Al, 0.2 to 4.5% of Mn, 0.0030 to 0.2% of Sn, 0.0030 to 0.15% of Sb, 0.0040 to 0.18% of P, and at least one of 0.0005 to 0.02% of Zn, and 0.0005 to 0.01% of Y; a remainder of Fe, and inevitable impurities, and satisfying Formula 1;

heating the slab;

manufacturing a hot-rolled steel sheet by hot rolling the slab;

manufacturing a cold-rolled steel sheet by cold rolling the hot-rolled steel sheet; and finally annealing the cold-rolled steel sheet, wherein:

after the finally annealing, the non-oriented electrical steel sheet includes inclusions, and inclusions with a diameter of 0.5 to 1.0 μm occupy 40 vol % or more of the entire inclusions, and the Formula 1 is:

$0.05 \leq ([Sn]+[Sb])/[P] \leq 25$ wherein [Sn], [Sb], and [P] represent contents of Sn, Sb, and P in wt %. [Formula 1]

11. The method of claim 10, wherein the slab includes, in wt %, 0.0005 to 0.02% of Zn and 0.0005 to 0.01% of Y.

12. The method of claim 11, wherein the slab satisfies Formula 2:

$[Zn]/[Y]>1$ wherein [Zn] and [Y] represent contents of Zn and Y in wt %. [Formula 2]

13. The method of claim 11, wherein the slab satisfies Formula 3:

$[Zn]+[Y] \leq 0.025$ wherein [Zn] and [Y] represent contents of Zn and Y in wt %. [Formula 3]

14. The method of claim 10, wherein the slab further includes in wt %, at least one of equal to or less than 0.0040% of N excluding 0%, equal to or less than 0.0040% of C excluding 0%, equal to or less than 0.0040% of S excluding 0%, equal to or less than 0.0040% of Ti excluding 0%, equal to or less than 0.0040% of Nb excluding 0%, and equal to or less than 0.0040% of V excluding 0%.

* * * * *